United States Patent [19]

Hirota et al.

[11] Patent Number: 5,048,317

[45] Date of Patent: Sep. 17, 1991

[54] METHOD OF MANUFACTURING DRAW-FORMED CONTAINER

[75] Inventors: Kazumi Hirota, Tokyo; Kikuo Matsuoka, Yokohama, both of Japan

[73] Assignee: Toyo Seikan Kaisha Ltd., Tokyo, Japan

[21] Appl. No.: 465,154

[22] PCT Filed: Jun. 4, 1988

[86] PCT No.: PCT/JP88/00541

§ 371 Date: Apr. 2, 1990

§ 102(e) Date: Apr. 2, 1990

[87] PCT Pub. No.: WO89/11930

PCT Pub. Date: Dec. 14, 1989

[51] Int. Cl.[5] ..... B21D 22/22

[52] U.S. Cl. ..... 72/347

[58] Field of Search ..... 72/60, 347

[56] References Cited

U.S. PATENT DOCUMENTS 3,724,247 4/1973 Page ..... 72/347

FOREIGN PATENT DOCUMENTS 279034 12/1987 Japan ..... 72/347

2092931 8/1982 United Kingdom ..... 72/347

*Primary Examiner*—Lowell A. Larson

*Attorney, Agent, or Firm*—Sughrue, Mion, Zinn, Macpeak & Seas

[57] ABSTRACT

This invention relates to a method of manufacturing a draw-formed container, comprising the step of suitably setting a ratio of a maximum diameter of an elastic sleeve to the diameter of the inlet of a female mold, the metal thickness of a metal covering sheet, and an axial load per circumferential area of a female mold, which the female mold receives at a lower dead point when the male and female molds are engaged with each other, whereby a draw-formed containter capable of preventing the occurrence of wrinkles, and having excellent appearance characteristics and a high corrosion resistance can be obtained.

7 Claims, 3 Drawing Sheets

METHOD OF MANUFACTURING DRAW-FORMED CONTAINER

BACKGROUND OF THE INVENTION

This invention relates to a method of manufacturing a draw-formed container, and more specifically to a method of manufacturing a draw-formed container having excellent appearance characteristics and corrosion resistance without the occurrence of creases from a metal foil or sheet having a coated surface.

PRIOR ART

A laminate produced by coating the surface of an aluminum foil or a surface treated steel foil with a coated layer or a resin film has heretofore been widely used in the field of food packaging containers because of its light weight or of the easiness of its disposal. Attempts have long been made to manufacture a cup-shaped container comprised of a tapered or cylindrical side wall portion, a closing bottom portion connected to its under part and a sealing flange portion connected to its upper part by draw-forming this laminate. However, creases occur in the side wall portion, particularly that part of the side wall portion to which the flange is attached, and give rise to a problem of impairing its appearance characteristics and sealing property.

As a solution to this problem, Japanese Patent Publication No. 4408/1982 describes that a male mold consisting of a rigid core and surrounding the rigid core, a sleeve made of an elastic material having a larger outside diameter than the inside diameter of a die cavity in the die shoulder portion with its tip portion composed of the above rigid core is used, and the outside surface of the material to be processed which is in contact with the die shoulder portion is draw-formed while this outside surface is being pressed by the elastic material.

U.S. Pat. No. 4,562,717 describes that in a similar draw-forming, the same tool as in the above prior art is used, but a space is provided between the rigid core and the elastic sleeve, and the elastic sleeve is increased in diametrical sectional area from its tip as it is directed to the rear side.

The invention of the above first prior art is considered to have a great significance in that it discloses a technique in which a male mold having an elastic sleeve is used, and by applying an elastic pressure of the material to be processed, the occurrence of creases is inhibited. In the second prior art, a space is provided between the elastic sleeve and the rigid core and adjusted so that immediately before the stroke end (bottom dead point) the amount of space becomes zero. Thus, the deformation of the elastic material in the radial direction is performed to a greater extent that its axial deformation to improve the maximum formable draw ratio.

However, when a coated metal sheet is actually draw-formed by using these forming methods, it frequently happens that the elastic sleeve is worn, or the coated metal sheet undergoes breakage. Specifically, these prior art methods have no sufficient recognition of the relation between the femal mold and the elastic sleeve of the male mold used, and this is believed to have resulted in these inconveniences.

SUMMARY OF THE INVENTION

The present inventors have found that the ratio between the inlet diameter (D) of the female mold and the maximum diameter ($d_2$) of the elastic sleeve and axial load which the female mold undergoes at the bottom dead point (d) per unit area of the circumferential area of the female mold when the male mold and the female mold are mated without a coated metal sheet are what act effectively for the inhibition of the occurrence of creases in the draw-forming of thin coated metal sheet, and that by selecting these values within certain fixed ranges, the occurrence of creases during forming can be inhibited effectively while preventing the wear of the elastic sleeve and the breakage of the coated metal sheet.

It is an object of this invention to provide a method by which a draw-formed container having a combination of excellent appearance characteristics, corrosion resistance and sealing performance can be manufactured with high productivity and at low costs while completely inhibiting the occurrence of creases during molding and preventing the wear of the elastic sleeve or the breakage of the coated metal sheet.

According to this invention, there is provided a method of manufacturing a draw-formed container which comprises using male mold comprised of a core of a rigid body and a sleeve of an elastic body provided around the rigid body, a female mold having a cavity corresponding to the outside shape of the final container, and a crease presser on the female mold, feeding a coated metal sheet between the male mold, the crease presser, and the female mold, and driving the male mold and the female mold axially so as to mate the male and female molds, wherein the ratio of the maximum diameter ($d_2$) to the inlet diameter (D) of the female mold satisfies the following relation $$1.0 < d_2/D < 1.2$$

the coated metal sheet has a metal thickness of not more than 0.2 mm, and the male and female molds are such that when they mate each other without the presence of the coated sheet, a load in the axial direction (load on the elastic body) which the female mold undergoes at the bottom dead point is 10 to 60 kg/cm$^2$ of the circumferential area of the female mold.

In this invention, a curvature portion having a radius of curvature (r) of 0.1 to 10 mm which engages the sleeve of the elastic body is preferably provided at the inlet of the female mold.

DESCRIPTION OF PREFERRED EMBODIMENTS

DRAW-FORMING

Figure 1:
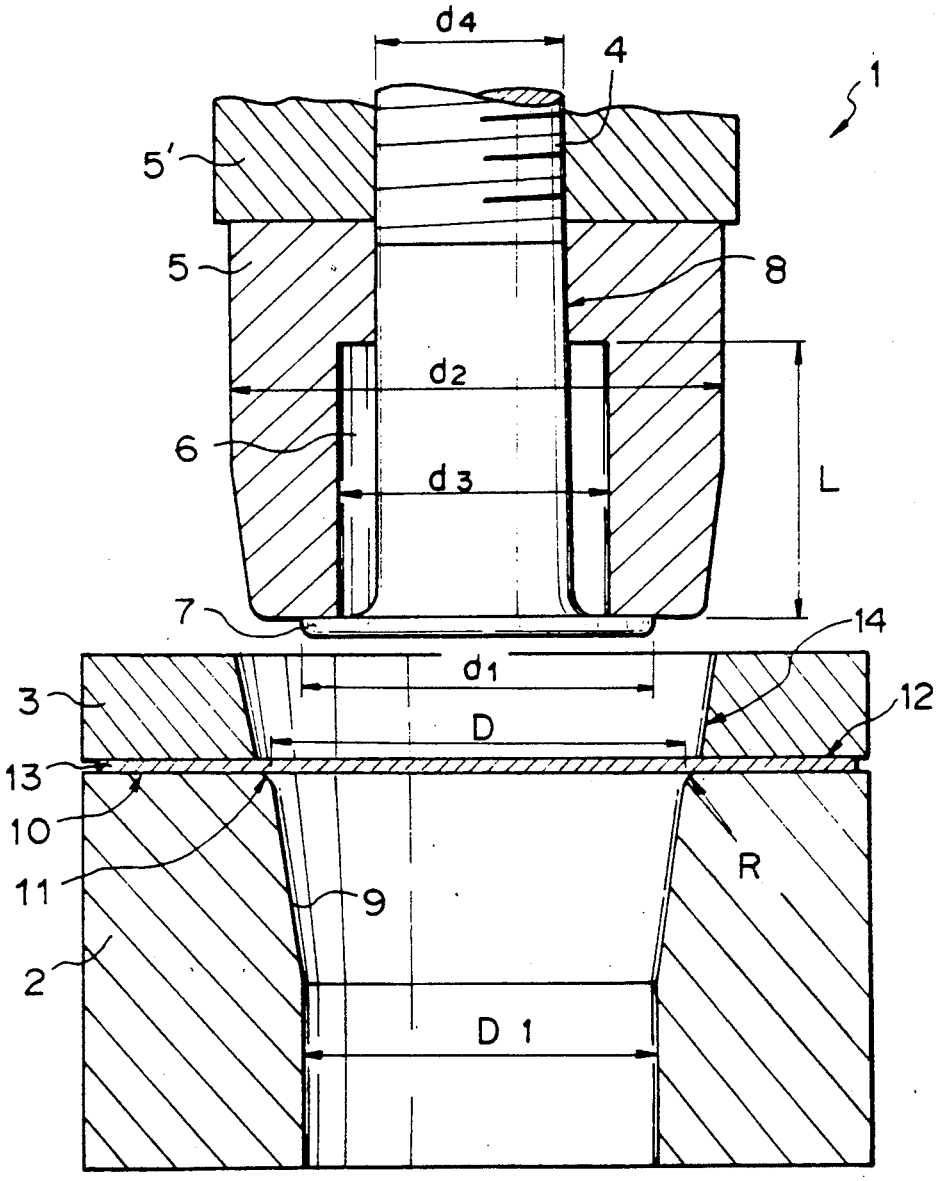
FIG. 1 is a side of arrangement of the device used in the draw-forming of this invention.

With reference to FIG. 1 showing the arrangement of the device used in the method of manufacturing the draw-formed container in this invention, the draw-forming device comprises a male mold 1, a female mold 2 and a crease presser 3 which are provided coaxially with each other. The male mold 1 is comprised of a core 4 of a rigid body, a sleeve 5 of an elastic body provided around the core 4 and a backup ring 5'. In the specific embodiment, the rigid body core 4 and the elastic body sleeve 5 are closed at the upper portion (the point of attachment) 8, but below it, a space 6 is formed between the rigid body core and the elastic body sleeve 5. A tip portion 7 having a large diameter is provided at the tip of the core 4 of the rigid body to support the sleeve 5 of the elastic body. Let the outside diameter of the elastic body sleeve 5 be $d_2$, the inside of the elastic body sleeve be $d_3$, and the diameter of the tip portion 7 of the rigid body core be $d_1$, the following relation is established $$d_2 > d_1 > d_3 \quad (1)$$

as can be seen from the drawings. The elastic body sleeve 5 is supported by the rigid body core 4 and the tip portion 7 so that it is allowed to deform in the diametrical direction.

The female mold 2 has a cavity 9 corresponding to the outside configuration of the final container, a surface 10 for supporting the coated metal sheet and a curvature portion 11 on the side of the inlet of the cavity. In the specific embodiment shown in the drawings, the cavity 9 is tapered and has an inlet diameter D, and the diameter ($D_1$) of the lower portion of the cavity 8 is equal to the sum of the diameter $d_1$ of the core tip portion and twice the thickness of the coated metal sheet or is slightly larger than it. Over the female mold 2 is provided the crease presser 3. The crease presser 3 has an under surface 12 for pressing the coated metal. The coated metal sheet to be formed is supported by the sheet supporting surface 10 of the female mold and the sheet pressing surface 12 of the crease presser, and a crease pressing force is applied to the sheet. The crease presser 3 has an opening 14 having a slightly larger diameter than the inlet diameter D of the female mold.

In the present invention, the maximum diameter ($d_2$) of the elastic body sleeve 5 to the inlet diameter (D) of the female mold is adjusted to a value satisfying the following expression $$1.2 > d_2/D > 1.0 \quad (2)$$

preferably $$1.5 > d_2/D > 1.03 \quad (3),$$

and they are combined with such male mold 1 and the female mold 2 that when they are mated with each other without the presence of the coated metal sheet, a load in the axial direction (load on the elastic body W) which the female mold undergoes at the bottom dead point becomes 10 to 60 kg/cm$^2$, preferably 15 to 50 kg/cm$^2$, or the circumferential area (A) of the female mold. As a result, even when a coated metal sheet 12 having a metal thickness of not more than 0.2 mm, especially not more than 0.15 mm, is draw-formed, the occurrence of creases in the side wall portion at the point of attachment of the flange portion can be completely inhibited. At the same time, sheet breakage during molding can be prevented and the wearing of the elastic body sleeve 5 can be prevented.

In the case of ordinary steel plates or aluminum plates, application of a sufficient crease pressing force during draw-forming can prevent the occurrence of a crease at the side wall portion. However, in the case of a thin metal sheet to which the present invention is directed, with an increase in the depth of stuffing the male mold, the circumferential stress ($\sigma\theta$) becomes a negative value, that is, the compression force irrespective of the magnitude of the crease pressing force. Consequently, the sheet cannot withstand the compression force, and creases occur. In this invention, by using the elastic body sleeve of the male mold, the elastic body (W) overcoming this compression force ($\sigma\theta$) is applied, and the occurrence of creases is prevented.

In this case, it is important, too, that the $d_2/D$ value be within the range of expression (2). If this value is less than 1.0, it is difficult to inhibit the occurrence of creases. On the other hand, if this value becomes more than 1.2, sheet breakage may occur during molding, or during the repetition of the molding operation, the elastic body may be worn out within a short period of time and the tool must be replaced. Or poor forming may result.

Matching of the male and female molds are best expressed by the $d_2/D$ value and the elastic body load (W/A) per unit area of the circumferential area of the female mold. Specifically, if the W/A value is 10 to 60 kg/cm$^2$, especially 15 to 50 kg/cm$^2$, the breakage of the sheet and the wear of the elastic body can be prevented while inhibiting the occurrence of creases irrespective directly of the hardness of the elastic body sleeve, the presence of a space between the elastic body sleeve and the rigid body core, the extent of this space. Specifically, if this W/A value is less than the above lower limit, sheet breakage may occur or the wear of the elastic body tends to occur during molding.

According to this invention, when the thickness of the coated metal sheet is t (cm), a container obtained by forming the metal sheet to a desired depth has a circumferential stress of $\sigma\theta$(kc/cm$^2$) at the side wall average radius position, the tangent coefficient is $f_o$ (kg/cm$^2$), the elastic coefficient of the sheet is E (kg/cm$^2$) and the height (W) of a permissible crease is (cm), it is most desirable for the prevention of the occurrence of creases, sheet breakage and the wearing of the elastic body to set the W/A value so that it satisfies the following equation.

$$\frac{W}{A} = k\,\frac{(\sqrt{E} + \sqrt{Fo})^2\omega(\sigma\theta)^2}{E \cdot Fo \cdot t} \quad (4)$$

wherein k is a coefficient which is generally 0.0025 to 0.05 for a steel foil, and 0.05 to 6 for an aluminum foil.

If the height (W) of a permissible crease is not more than $5\times10^{-4}$ cm, especially not more than $2\times10^{-4}$ cm, it is not perceived visually as a crease, and there is no problem with respect to the corrosion resistance and the sealing property of the container. The tangent coefficient ($F_o$) of the sheet is expressed by the following equation when the stress is $\sigma$(kg/cm$^2$) and its strain is $\epsilon$.

$$Fo = \left[\frac{\delta\sigma}{\delta\epsilon}\right]_{\epsilon=\epsilon\theta} \quad (5)$$

wherein $\epsilon\theta$ is a strain in the circumferential direction at the side wall average radius position when the sheet is formed to a desirable depth.

When the 0.2% resisting strength (the stress which leaves 0.2% of a permanent stress) is $\sigma_{0.2}$ (kg/cm$^2$), can be determined from the following equation.

$$\sigma\theta = A + B \cdot \sigma_{0.2}.$$

In this equation, A is 0.3 to 45 and B is −0.2 to −0.9 which are determined depending upon the material and the forming conditions. The 0.2% resisting strength of the sheet can be represented by its yield strength if the material of the sheet is known.

Figure 2:
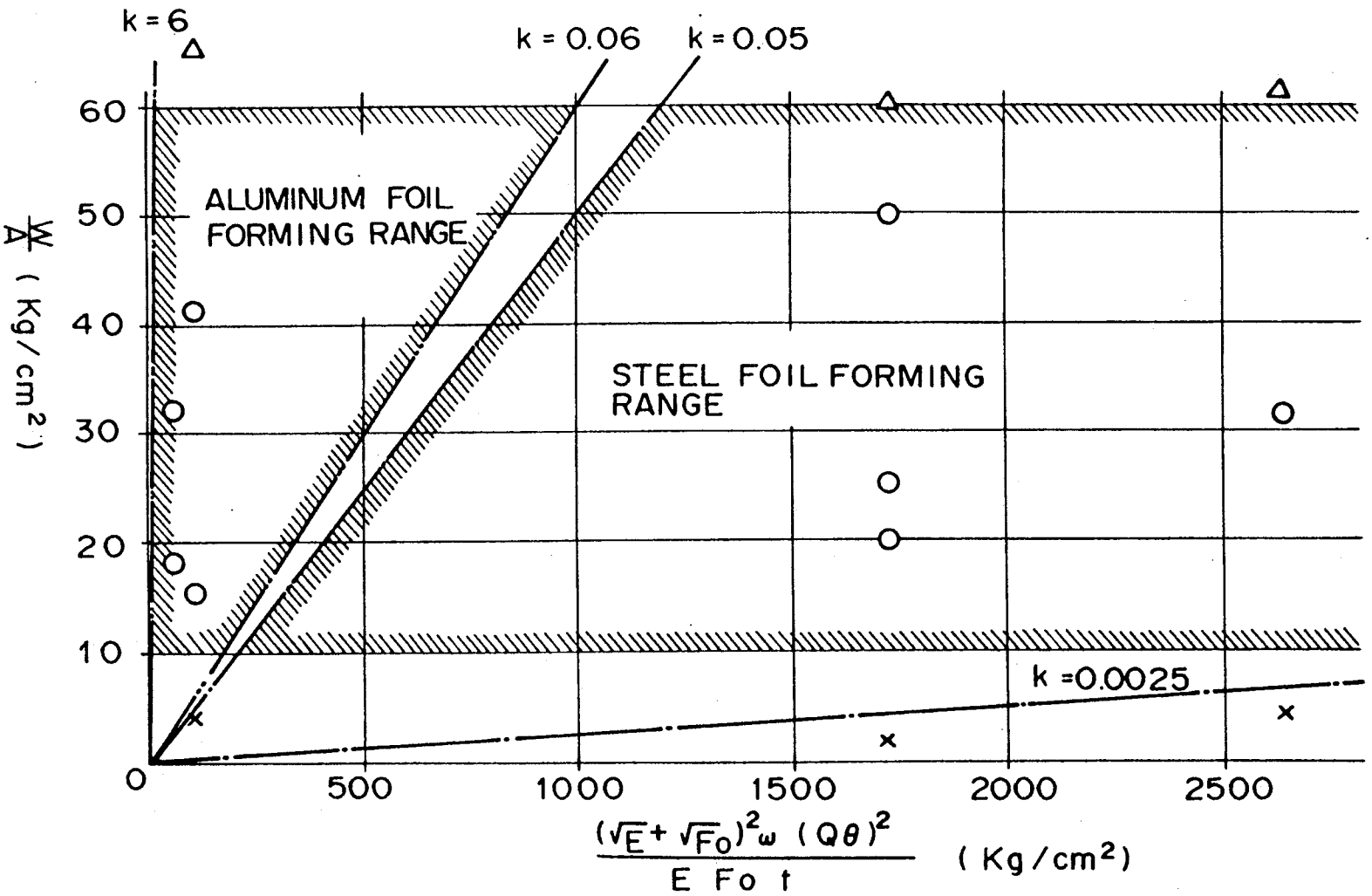
FIG. 2 is a diagram showing the correspondence of the load (W/A) of the elastic body per unit area to the maximum crease pressing force calculated from the various characteristic values of the sheet.

FIG. 2 shows the actually measured W/A value plotted on the axis of ordinates and the calculated $$\frac{(\sqrt{E} + \sqrt{Fo})^2 \omega (\sigma\theta)^2}{E \cdot Fo \cdot t}$$

value with respect to a laminated sheet of polypropylene/steel foil (or aluminum foil/polypropylene with varying thicknesses and types. The mark ○ shows that none of sheet breakage and the wearing of the elastic body occurred. The mark X showed that creases occurred. The mark Δ showed that sheet breakage or the wearing of the elastic body occurred. The results demonstrated that if k is 0.0025 to 0.05 for a steel foil and 0.3 to 6 for an aluminum foil, the results were good in all respects.

In the present invention, it is generally desirable that the curvature portion 11 at the inlet of the female mold has a radius of curvature (r) of 0.1 to 10 mm. If this radius of curvature (r) is larger than the above upper limit, it tends to become difficult to inhibit the occurrence of creases stably. If, on the other hand, it is smaller than the lower limit, it tends to become difficult to inhibit sheet breakage stably.

By the forming method of this invention, the coated metal sheet 13 to be formed is fed between the male mold 1 and the crease presser 3, and a certain level of the crease pressing force is applied to the sheet 13 between them. Then, the male member 1 is lowered and the coated metal sheet 13 is draw-formed while pressing it against the cavity 9 of the male mold 1 by the elastic body sleeve 5. Prior to the draw-forming, body surfaces of the coated metal sheet 13 are coated with a lubricant. This is generally advantageous in view of the operability of the draw-forming.

COATED SHEET

Figure 3:
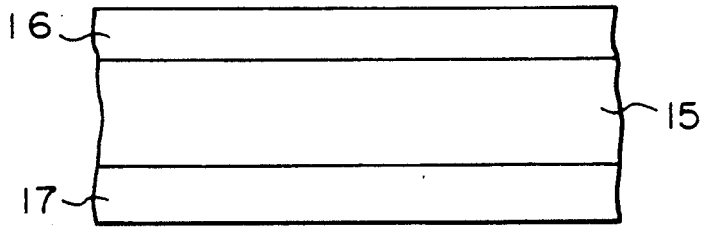
FIG. 3 is a sectional view of one example of the coated metal sheet used.

In FIG. 3 showing one example of the coated metal sheet used in this invention, this coated metal sheet 13 consists of a substrate 15 of a metal foil or a thin metal plate and resin coated layers 16 and 17 formed on both surfaces of the substrate.

A slightly thicker sheet than an iron foil, a steel foil or a surface-treated steel foil may be used as the metal substrate. Generally, its thickness is preferably 0.01 to 0.2 mm, especially 0.05 to 0.15 mm. A steel foil having a surface-treated layer, particularly a metal plated layer, or a surface-treated layer composed of the metal plated layer and further a chromate layer formed thereon is very desirable in this invention in view of corrosion resistance and the adhesion of the organic resin coating. Although the organic resin coating may be effective to prevent direct contacting of the contents with an iron or steel foil, this resin coating is very permeable to hydrogen ions from an organic acid contained in the contents having highly corrosive property, and also has the property of being slightly permeable to anions such as a chloride ion contained in salts, too. For this reason, peeling of the coating tends to occur in the interface between the foil and the organic resin coating. Once this peeling occurs, the corrosion of this portion manifested by rusting, dissolution of iron and pitting corrosion, for example, readily proceeds.

According to the above embodiment, by providing a surface-treated layer composed of a metal-plated layer or further a chromate layer on a steel foil, this metal-plated layer acts as a barrier layer against the above-mentioned corrosive components, and further serves to increase adhesion to the organic resin coated layer. When at this time, the chromate layer is further provided on the metal-plated layer, the adhesion of the organic resin layer is further increased.

As the metal-plated layer, metals being milder than iron and showing anticorrosive effect on iron, for example, Ni, Sn, Zn and Al, are used advantageously. The plated layers composed of these metals have an excellent anticorrosive effect. A nickel-plated layer is especially excellent in barrier effect on corrosive components. A tin-plated foil, i.e. a tin plate, may be cited as a plated steel foil that is easily available. The tin plate foil can provide sufficient corrosion resistance and adhesion to an organic coating even if the amount of tin coated is relatively small, for example, 0.5 to 10 g/m$^2$. In this case, the tin layer may be present as a metallic tin layer, but in view of its adhesion to a resin, it is preferably present in the form of a tin-iron alloy in an Sn metal to Fe metal ratio of from 2 to 1.

The chromate layer may be, for example, a chromium oxide layer comprising chromate oxide hydrate coated in an amount of, as Cr, 1 to 50 mg/m$^2$, especially 3 to 35 mg/m$^2$, as a main component. This chromate layer can be formed on the plated layer by a known chemical formation treatment and/or a chemical treatment.

This surface-treated steel foil may be a tin-free steel foil having a metallic chromium layer as a plated layer and a chromate layer formed on it. Desirably, this metallic chromium layer is coated at a rate of 0.03 to 0.5 g/m$^2$, especially 0.05 to 0.3 g/m$^2$.

The metal-plated layer is not limited to a single metal layer. It may be a layer of a plurality of dissimilar metals. For example, the metal-plated layer may be composed of a layer of a mild metal such as nickel as a substrate plated layer, and formed thereon a chromium metal layer formed by electrolytic chromic acid treatment. It may also comprise a chromium oxide layer formed on it.

The steel foil may be ductile or full hard. The former type is obtained by annealing a cold-rolled steel plate, subjecting it to secondary cold-rolling, again annealing it, and as required, subjecting it to one or more after-treatments such as zinc plating, tin plating, nickel plating, electrolytic chromic acid treatment and chromic acid treatment. The latter type can be obtained by annealing a cold-rolled steel plate, subjecting it to secondary cold rolling, and as required, subjecting it to such after-treatments as zinc plating, tin plating nickel plating, electrolytic chromic acid treatment and chromic acid treatment. The full hard type having a metal-plated layer can be produced by annealing a cold-rolled steel plate, tempering it, forming a metal-plated layer, and then subjecting it to secondary cold-rolling.

The coated sheet having a steel foil as a substrate generally has the following characteristics.

$\theta_{0.2}$: 3000 to 5000

E: $1.5\times10^6$ to $3\times10^6$.

An aluminum foil or a thin aluminum sheet may be used as the metal substrate. As the aluminum, not only pure aluminum but also aluminum alloys such as an aluminum/manganese alloy and an aluminum/magnesium alloy may be used. Preferably, the aluminum substrate generally have a thickness of 0.007 to 0.2 mm, particularly, 0.05 to 0.15 mm. The coated sheets having aluminum as a substrate generally have the following characteristics.

$\sigma_{0.2}$: 300 to 1400

E: $5\times10^5$ to $9\times10^5$

As the organic resin coatings 16 and 17, plastic films or various resin paints may be used.

The plastic films may be, for example, films of any resins which are film-forming and can be deep-drawn in the form of a laminate with a steel foil. Suitable examples of such resins are shown below, although they are not limitative.

(a) Polyolefins such as polypropylene, polyethylene, polybutene-1, propylene/ethylene copolymer, propylene/butene-1 copolymer, ethylene/vinyl acetate copolymer, ionically crosslinked olefin copolymers (ionomers) and ethylene/ethyl acrylate copolymer.

(b) Polyamides, especially those composed of recurring units of the general formula $$\left[NH\left[CH_2\right]_n\overset{O}{\overset{\|}{C}}\right] \quad \text{(I)}$$

or $$\left[NH\left[CH_2\right]_n NH-\overset{O}{\overset{\|}{C}}\left[CH_2\right]_m\overset{O}{\overset{\|}{C}}\right] \quad \text{(II)}$$

In the formulae, n is a number of 3 to 13, and m is a number of 4 to 11.

For example, they are poly-omega-aminocaproic acid, poly-omega-aminoheptanoic acid, poly-omega-aminocaprylic acid, poly-omega-aminopelargonic acid, poly-omega-aminodecanoic acid, poly-omega-aminoundecanoic acid, poly-omega-aminododecanoic acid, poly-omega-aminotridecanoic acid, polyhexamethylene adipamide, polyhexamethylene sebacamide, polyhexamethylene dodecamide, polyhexamethylene tridecamide, polydecamethylene adipamide, polydecamethylene sebacamide, polydecamethylene dodecamide, polydecamethylene tridecamide, polydodecamethylene adipamide, polydodecamethylene sebacamide, polydodecamethylene dodecamide, polydodecamethylene tridecamide, polydecamethylene adipamide, polytridecamethylene sebacamide, polytridecamethylene dodecamide, polydecamethylene tridecamide, polydodecamethylene adipamide, polydodecamethylene tridecamide, polytridecamethylene adipamide, polytridecamethylene sebacamide, polytridecamethylene dodecamide, polytridecamethylene tridecamide, polyhexamethylene azelamide, polydecamethylene azelamide, polydodecamethylene azelamide, polytridecamethylene azelamide and copolyamides of these.

(c) Polyesters, particularly those composed of recurring units represented by the general formula $$\left[O-R_1-O-\overset{O}{\overset{\|}{C}}-R_2-\overset{O}{\overset{\|}{C}}\right] \quad \text{(III)}$$

or

-continued $$\left[O-R_1-O-R_2-\overset{O}{\overset{\|}{C}}\right] \quad \text{(IV)}$$

wherein $R_1$ represents an alkylene group having 2 to 6 carbon atoms, and $R_2$ represents an alkylene or arylene group having 2 to 24 carbon atoms.

Examples include polyethylene terephthalate, polyethylene terephthalate/isophthalate, polytetramethylene terephthalate, polyethylene/tetramethylene terephthalate, polytetramethylene terhthalate/isophthalate, polyethylene terephthalate/isophthalate, polytetramethylene/ethylene terephthalate, polyethylene/tetramethylene terephthalate/isophthalate, polyethylene/-hydroxybenzoate, and blends of these.

(d) Polycarbonates, particularly those represented by the general formula $$\left[O-R_3-O-\overset{O}{\overset{\|}{C}}\right] \quad \text{(V)}$$

wherein $R_2$ represents a hydrocarbon group having 8 to 15 carbon atoms.

Examples include poly-p-xylylene glycol biscarbonate, poly-dioxydiphenyl-methane carbonate, poly-dioxydiphenylethane carbonate, poly-dioxydiphenyl 2,2-propane carbonate, and poly-dioxydiphenyl 1,1-ethane carbonate.

(e) Vinyl chloride resins such as polyviyl chloride, vinyl chloride/butadiene copolymer and vinyl chloride/styrene/butadiene copolymer.

(f) Vinylidene chloride resins such as vinylidene chloride/vinylidene chloride copolymer and vinylidene chloride/vinylpyridene copolymer.

(g) High nitrile resins such as acrylonitrile/butadiene, acrylonitrile/styrene and acrylonitrile/styrene/butadiene copolymers having a high nitrile content.

(h) Polystyrene resin and styrene/butadiene copolymer.

Desirably, the thickness of the thermoplastic resin film layer is generally 10 to 150 micrometers, particularly 30 to 100 micrometers. If the thickness is smaller, the covering effect against corrosion of the resin film tends to be lost. If it is larger outside the above range, the draw-formability of the sheet is reduced.

Inclusion of an inorganic filler or pigment in at least one of, particularly, both of the resin film layers is desirable for increasing the deep draw-formability of the laminate. Examples of adhesives used to laminate these films are isocyanate-type adhesives, epoxy-type adhesives, and acid-modified olefinic resin adhesives. Particularly, there can be cited polyester-urethane adhesives and polyester/epoxy/urethane adhesives.

Examples of the polyester-urethane adhesives are an adhesive obtained by reacting a hydroxyl-terminated polyester with a diisocyanate and crosslinking the resulting isocyanate and crosslinking the resulting isocyanate-terminated polyester-urethane with water or a polyhydric alcohol as a crosslinking agent and an adhesive obtained by reacting a polyhydric alcohol, a polycarboxylic acid and a diisocyanate and crosslinking the resulting hydroxyl-terminated polyester-urethane with a diisocyanate as a crosslinking agent. The latter type is especially suitable.

Examples of the polycarboxylic acid constituting the polyester include succinic acid, adipic acid, sebacic acid and decanecarboxylic acid. Examples of the polyhydric alcohol are ethylene glycol, propylene glycol, butanediol, glycerol, neopentyl glycol, ethyrhritol, sorbitol and mannitol. Examples of the diisocyanate are xylene diisocyanate, tolylene diisocyanate, cyclohexane diisocyanate and isophorone diisocyante.

The type of polyester-urethane adhesives, because of the presence of the urethane group, gives strong bonding, generally an adhesion strength of 1.4 to 1.8 kg/15 mm, to the steel foil and plastic films. Owing to the presence of soft segments introduced by the polyester and hard segments introduced by the diisocyante in the main chain, a moulus in the above-given range, particularly, in the range of 4000 to 9000 kg/cm$^2$, is imparted. As the polyester-epoxy-urethane adhesive, a composition comprising a hydroxyl-terminated polyester, an epoxy resin and a diisocyanate crosslinking agent may be used. The polycarboxylic acid, the polyhydric alcohol and the dissocyanate constituting the polyester may be the same as exmplifed above. An epoxy resin obtained by reacting bisphenol A with epichlorohydrin may be used, for example, as the epoxy resin.

The polyester-epoxy-urethane adhesive also shows the same adhesive strength as the polyester urethane adhesive because of the presence of the urethane group, and its modulus is 1020 to 5100 kg/cm$^2$.

On the other hand, as the acid-modified olefinic resin adhesive, olefinic resins such as polypropylene, polyethylene and propylene/ethylene copolymer having grafted thereto an ethylenically unsaturated carboxylic acid or its anhydride such as maleic anhydride, acrylic acid or methacrylic acid may be used.

Lamination and bonding of the metal substrate and plastic films may be achieved by coating an organic solvent solution or dispersion of the adhesive on the metal substrate or the film surface, evaporating the solvent, and bonding the two materials under pressure. The preferred amount of the adhesive coated is in the range of 4.0 to 8.0 g/m$^2$. The resin coating may be coated films of various kinds of resin used instead of the plastic films.

Known protective coatings showing excellent adhesion to the metal substrates may be used as the protective film. Examples of the protective paints include thermosetting or thermoplastic resin paints, for example, modified epoxy paints such as a phenol-epoxy paint, an amino-epoxy paint and an epoxy-ester paint; for example, vinyl and modified vinyl paints such as vinyl chloride/vinyl acetate copolymer, a partially saponified product of vinyl chloride/vinyl acetate copolymer, vinyl chloride/vinyl acetate/maleic anhydride copolymer, epoxy modified/epoxy amino-modified/ or epoxy-phenol modified vinyl resin; acrylic resin-type paints; oily paints; alkyd paints; polyester paints; and a synthetic rubber-type paints such as styrene/butadiene-type copolymer.

The protective coated film may be a single coated film, or may be a combination of an undercoat and a topcoat. It is possible to provide a printed layer on the undercoat, and form a finishing varnish layer.

Desirably, the thickness of the coated film is generally 1 to 30 micrometers, especially 3 to 20 micrometers.

In the coated metal sheet used in this invention, a film may be provided on one surface of the metal substrate, and a coated film may be coated on the other surface. It should be understood that the film and the coated film may be formed on the same surface.

DRAW-FORMED CONTAINER

Figure 4:
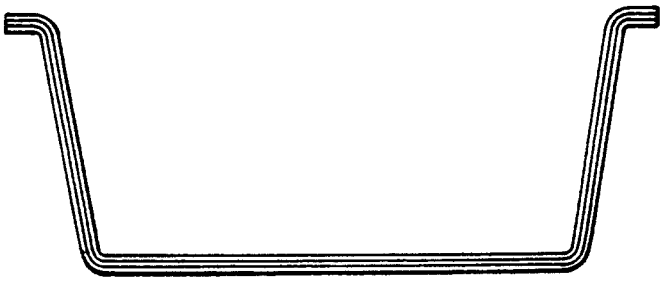
FIGS. 4 and 5 are side sectional views of draw-formed containers.

In FIG. 4 showing one example of the draw-formed container of this invention, the container 20 is composed of a bottom portion 21, a side wall portion 22 connected to the bottom position vertically or upwardly in a fan-like spreading manner, and a flange portion 23 provided at the upper end of the side wall portion. A cutedge 24 exists outside of the flange portion 23. In the case of the steel foil, this cut edge becomes a sharp blade, and on contact, a finger, for example, may readily undergo injury. According to this invention, by providing a resin coating layer of the above thickness, the above risk can be completely obviated, and it is possible to secure safety in a packaging material using a steel foil.

Figure 5:
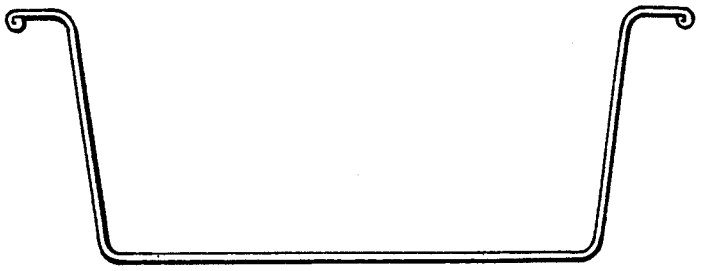

In FIG. 5 showing another example of the draw-formed container of the invention, this container, like that shown in FIG. 4, is formed of a bottom portion 21, side wall portion 22 and a flange portion 23. A curl portion 25 formed by rounding a laminate material is provided in the outermost line of the flange portion 23.

It should be understood that the shape of the bottom portion of this container may be any shape such as a circular, elliptical, square, rectangular, hexagonal or octagonal shape.

It should also be understood that by using a heat-sealable resin film as an inside material resin, scaling by heat sealing can be easily achieved between the container and a closure material.

The shape of the container may be that of a so-called deep-drawn container or of a tray-like shallow-draw container. The side wall of the container may be tapered or straight, or one or more steps or a bead may be formed in the side wall. The draw ratio, generally defined by the ratio of the diameter of the blank to the diameter of the tip of the punch, is in the range of from 1.3 to 2.5, particularly from 1.6 to 2.3. Generally the drawing operation may generally be sufficient in one step. Needless to say, the draw forming operation can be performed in two or more steps.

EXAMPLES

The following examples illustrate the present invention.

EXAMPLE 1

Polypropylene having a thickness of 40 microns, a steel foil having a thickness of 75 microns, and polypropylene having a thickness of 70 microns were bonded to product a three-layer laminate material. This material had an E of $2.4\times10^6$ kg/cm$^2$, and the stress/strain relation was expressed by the following equation.

$$\sigma=52\epsilon^{0.014}.$$

A blank of 120 mm was punched out from this material, and a cup having a mouth inside diameter of 65 mm and a depth of 30 mm was formed. At this time, $F_0=145$ kg/cm$^2$, $6\theta=-4290$ kg/cm$^2$ and the permissible crease height $\omega$ was $1\times10^{-4}$ cm.

The $$\frac{(\sqrt{E}+\sqrt{F_0})^2\omega(\sigma\theta)^2}{E\cdot F_0\cdot t}$$

determined was 1718 kg/cm$^2$. If 0.013 was selected as k. W/A was determined to be 22.3 cm$^2$. A male mold was made to satisfy these values ($d_2$=70.9 mm, $d_3$=40 mm, $d_4$=24, L=30 mm, rubber hardness=80°, $d_2/D$=1.09).

This male mold, and a female mold having a D of 65 mm and an R of 1.0 mm were used, and a cup was draw-formed. The actually measured maximum load of the elastic body W was 1550 kg, and the circumferential area of the female mold (A) was 61.2 cm$^2$. The W/A value was 25.3 kg/cm$^2$. The resulting cup was creaseless and was of good quality.

EXAMPLE 2

Example 1 was repeated except that a male mold having a hardness of 70 was used. W/A was 20.1 kg/cm$^2$, slightly lower, but the resulting cup was of good quality.

COMPARATIVE EXAMPLE 1

In Example 1, 0.035 was selected as k, and a male mold having a rubber hardness of 90° was made, and otherwise, the same draw-forming was carried out. The maximum clastic body load became 3700 kg (W/A=60.5 kg/cm$^2$). Formation could be carried out well without breakage and creases. But when the formation cycles exceeded 5000, the surface of the rubber was damaged, and poor forming occurred.

COMPARATIVE EXAMPLES 2 and 3

When in Example 1 the maximum rubber diameter $d_2$ was changed to 80 mm and 64 mm, respectively, $1.0<d_2/D<1.2$ was not satisfied. Creases occurred, and the material was broken, and the rubber was damaged.

COMPARATIVE EXAMPLE 4

When in Example 1, the hardness of the punch was changed to 30°, heavy creases occurred in the side wall of the formed cup.

EXAMPLE 3

In Example 1, draw-forming was carried out by using a male mold ($d_2/D$=1.12) including a die having an inside diameter of 100 mm and a rubber having a maximum diameter of 112 mm. The maximum elastic body load was 2800 kg and W/A was 29.7 kg/cm$^2$ (circumferential area A of the female mold A=94.2 cm$^2$), and draw-forming could be performed well.

EXAMPLE 4

When in Example 3, the maximum diameter of the rubber in the male mold was changed to 105 mm and its hardness was changed to 90°, $d_2/D$ became 1.05, the maximum elastic body load W became 2500 kg and the W/A ratio became 26.5 kg/cm$^2$ and good results were obtained.

COMPARATIVE EXAMPLE 5

When in Example 3, the maximum diameter of the rubber was changed to 125 mm, the maximum elastic body load became 5800 kg and W/A became 61.6 kg/cm$^2$. Draw-forming became impossible.

COMPARATIVE EXAMPLE 6

When in Example 3, the rubber hardness of the male mold was changed to 90°, the maximum elastic body load became 5790 kg and W/A became 61.5 kg/cm$^2$, and draw-forming could not be carried out.

COMPARATIVE EXAMPLE 7

When in Example 3, the maximum diameter of the rubber of the male mold was changed to 99 mm ($d_2/D$=0.99), heavy creases occurred in the upper parts of the side wall portion of the formed cup.

COMPARATIVE EXAMPLE 8

When in Example 3, the rubber hardness of the male mole was changed to 30°, marked creases occurred in the side wall of the formed cup.

EXAMPLE 5

When in Example 1, the maximum diameter ($d_2$) of the rubber of the male mold was changed to 69 mm and the diameter of the cavity ($d_3$) was changed to 24 mm, and a male mold having no cavity was used, the maximum elastic body load (W) became 3050 kg, somewhat larger. W/A became 49.8 kg/cm$^2$, and a cup of good quality without creases and breakage could be obtained. No problem arose with regard to the damage of the rubber.

EXAMPLE 6

Example 1 was repeated except that the cavity diameter ($d_3$) of the male mold was changed to 43 mm and the cavity length (L) was changed to 40 mm. The maximum elastic body load W was 1150 kg, somewhat lower. But W/A was 18.8 kg/cm, and a cup of good quality without creases and breakage was obtained.

TABLE 1

| Example No. (*) | Inside diameter of the die (D) (mm) | Forming height (mm) | Maximum diameter of the rubber ($d_2$) (mm) | $d_2/D$ | Hardness of the rubber (*) | Maximum elastic body load (W) (kg) |
|---|---|---|---|---|---|---|
| Ex. 1 | 65 | 30 | 70.9 | 1.09 | 80 | 1550 |
| Ex. 2 | 65 | 30 | 70.9 | 1.09 | 70 | 1230 |
| C. Ex. 1 | 65 | 30 | 70.9 | 1.09 | 90 | 3700 |
| C. Ex. 2 | 65 | 30 | 80 | 1.23 | 80 | 4800 |
| C. Ex. 3 | 65 | 30 | 64 | 0.98 | 80 | 250 |
| C. Ex. 4 | 65 | 30 | 70.9 | 1.09 | 30 | 120 |
| Ex. 3 | 100 | 40 | 112 | 1.12 | 80 | 2800 |
| Ex. 4 | 100 | 40 | 105 | 1.05 | 85 | 2500 |
| C. Ex. 5 | 100 | 40 | 125 | 1 25 | 80 | 5800 |
| C. Ex. 6 | 100 | 40 | 112 | 1.12 | 95 | 5790 |
| C. Ex. 7 | 100 | 40 | 99 | 0.99 | 95 | 1200 |
| C. Ex. 8 | 100 | 40 | 112 | 1.12 | 30 | 150 |

TABLE 1-continued

| | | | | | | |
|---|---|---|---|---|---|---|
| Ex. 5 | 65 | 30 | 69 | 1.06 | 80 | 3050 |
| Ex. 6 | 65 | 30 | 70.9 | 1.09 | 80 | 1150 |

| Example No. | Circumferential area (A) of the female mold ($cm^2$) | W/A | Results of evaluation: Crease occurrence | Material breakage | Damage of the rubber |
|---|---|---|---|---|---|
| Ex. 1 | 61.2 | 25.3 | | | |
| Ex. 2 | 61.2 | 20.1 | | | |
| C. Ex. 1 | 61.2 | 60.5 | | | X |
| C. Ex. 2 | 61.2 | 78.4 | *1 | X | X |
| C. Ex. 3 | 61.2 | 4.1 | X | | |
| C. Ex. 4 | 61.2 | 1.9 | X | | |
| Ex. 3 | 94.2 | 29.7 | | | |
| Ex. 4 | 94.2 | 26.5 | | | |
| C. Ex. 5 | 94.2 | 61.6 | *1 | X | X |
| C. Ex. 6 | 94.2 | 61.5 | *1 | X | X |
| C. Ex. 7 | 94.2 | 12.7 | X | | |
| C. Ex. 8 | 94.2 | 1.6 | X | | |
| Ex. 5 | 61.2 | 49.8 | | | |
| Ex. 6 | 61.2 | 18.8 | | | |

*Example = Ex. Comparative Example = C. Ex.
*1: forming impossible

What is claimed is:

1. In a method of manufacturing a draw-forming container which comprises using a male mold comprised of a core of a rigid body and a sleeve of an elastic body provided around the rigid body, a female mold having a cavity corresponding to the outside shape of the final container, and a crease presser on the female mold, feeding a coated metal sheet between the crease presser and the female mold, and driving the male mold and the female mold axially so as to mate the male and female molds an improvement wherein the ratio of a maximum diameter ($d_2$) of the male mold to an inlet diameter (D) of the female mold satisfies the following relation $$1.2 > d_2/D > 1.03$$

the coated metal sheet has a metal thickness of not more than 0.2 mm, and the male and female molds are such that when they mate each other without the presence of the coated sheet, a load in the axial direction (load on the elastic body) which the female mold undergoes at a bottom dead point is 10 to 60 $kg/cm^2$ of the circumferential area of the female mold.

2. The method of claim 1 in which at the inlet of the female mold, a curvature portion having a radius of curvature (r) of 0.1 to 10 mm which engages the elastic body sleeve is provided.

3. A method according to claim 1, wherein the ratio of a maximum diameter ($d_2$) of the male mold to an inner diameter (D) of the female mold satisfies the following relation:

$$1.15 > d_2/D > 1.03.$$

4. In a method of manufacturing a draw-formed container which comprises using a male mold comprised of a core of a rigid body and a sleeve of an elastic body provided around the rigid body, a female mold having a cavity corresponding to the outside shape of the final container, and a crease presser on the female mold, feeding a coated metal sheet between the crease presser and the female mold, and driving the male mold and the female mold axially so as to mate the male and female molds;

an improvement wherein said coated metal sheet comprises a substrate selected from the group consisting of iron, steel and a surface-treated steel having a thickness of 0.01 to 0.2 mm and resin coated layers formed on both surfaces of the substrate;

the ratio of a maximum diameter ($d_2$) of the male mold to an inlet diameter (D) of the female mold satisfies the following relation $$1.03 < d_2/D < 1.2;$$

and the male and female molds are such that when they mate each other without the presence of the coated sheet at a bottom dead point, a load (W/A) in the axial direction per unit area of the circumferential area of the female mold is in the range of 10 to 60 $kg/cm^2$ and satisfies the following formula:

$$\frac{W}{A} = K\frac{(\sqrt{E} + \sqrt{Fo})^2\omega(\delta\theta)^2}{F \cdot Fo \cdot t}$$

wherein k is a coefficient of from 0.0025 to 0.05, t is a thickness (cm) of the coated metal sheet, E is an elastic coefficient ($kg/cm^2$) of the coated metal sheet, Fo is a tangent coefficient ($kg/cm^2$) of the coated metal sheet, $\omega$ is a height of a permissible crease and $\delta\theta$ is a circumferential stress ($kg/cm^2$) at the side wall average radius position of the container.

5. A method according to claim 4, wherein the surface-treated steel is a tin-free steel foil.

6. A method according to claim 5, wherein said tin-free steel has a metallic chromium layer of 0.03 to 0.5 $g/m^2$.

7. In a method of manufacturing a draw-formed container which comprises using a male mold comprised of a core of a rigid body and a sleeve of an elastic body provided around the rigid body, a female mold having a cavity corresponding to the outside shape of the final container, and a crease presser on the female mole, feeding a coated metal sheet between the crease presser and the female mold, and driving the male mold and the female mold axially so as to mate the male and female molds;

an improvement wherein said coated metal sheet comprises a substrate of aluminum having a thickness of 0.007 to 0.2 mm and resin coated layers formed on both surfaces of the substrate;

the ratio of a maximum diameter ($d_2$) of the male mold to an inlet diameter (D) of the female mold satisfies the following relation $$1.03 < d_2/D < 1.2;$$

and the male and female molds are such that when they mate each other without the presence of the coated sheet at a bottom dead point, a load (W/A) in the axial direction per unit area of the circumferential area of the female mold is in the range of 10 to 60 kg/cm$^2$ and satisfies the following formula:

$$\frac{W}{A} = K\frac{(\sqrt{E} + \sqrt{Fo})^2\omega(\delta\theta)^2}{E \cdot Fo \cdot t}$$

wherein k is a coefficient of from 0.06 to 6, t is a thickness (cm) of the coated metal sheet, E is an elastic coefficient (kg/cm$^2$) of the coated metal sheet, Fo is a tangent coefficient (kg/cm$^2$) of the coated metal sheet, $\omega$ is a height of a permissible crease and $\delta\theta$ is a circumferential stress (kg/cm$^2$) at the side wall average radius position of the container.

* * * * *